United States Patent [19]

Levine et al.

[11] Patent Number: 4,742,192

[45] Date of Patent: May 3, 1988

[54] STEERING WHEEL RIM HORN BLOW MECHANISM

[75] Inventors: Aaron B. Levine, Detroit, Mich.; George R. Moore, Glashuetten, Fed. Rep. of Germany

[73] Assignee: Saturn Corporation, Troy, Mich.

[21] Appl. No.: 56,232

[22] Filed: Jun. 1, 1987

[51] Int. Cl.[4] ..... H01H 9/00

[52] U.S. Cl. ..... 200/61.57

[58] Field of Search ..... 200/61.54–61.57, 200/5 A, 61.43, 86 R

[56] References Cited

U.S. PATENT DOCUMENTS

| | | | |
|---|---|---|---|
| 2,796,484 | 6/1957 | Wolf | 200/61.57 |
| 2,943,164 | 6/1960 | Kniffin, Jr. | 200/61.57 |
| 2,946,869 | 7/1960 | Parks et al. | 200/61.57 |
| 3,243,540 | 3/1966 | Miller | 200/86 R |
| 3,476,897 | 11/1969 | De Vincent | 200/61.57 |
| 3,478,311 | 11/1969 | Czingula | 200/86 R X |
| 3,485,974 | 12/1969 | Wolf et al. | 200/61.57 |
| 3,544,746 | 12/1970 | Wolf et al. | 200/61.57 X |
| 3,699,294 | 10/1972 | Sudduth | 200/86 R X |
| 3,718,791 | 2/1973 | Szablowski | 200/86 R X |
| 3,860,771 | 1/1975 | Lynn et al. | 200/5 A |
| 3,876,844 | 4/1975 | Scherenberg | 200/61.57 |
| 4,046,975 | 9/1977 | Seeger, Jr. | 200/5 A |

*Primary Examiner*—J. R. Scott

*Attorney, Agent, or Firm*—R. L. Phillips

[57] ABSTRACT

A vehicle steering wheel includes an annular metal core with a molded plastic body and may include an outer molded layer of vinyl, wrap of leather or the like. A recess is provided extending along the inside rim of the wheel. An elastomeric cover, such as urethane rubber, covers the switch. Annular voids in the elastomeric cover may be selectively placed to provide the desired resilient characteristic. The strip switch preferably includes two outer strips and one inner strip of thin, flexible plastic. Electrically conductive, silver ink coatings are provided on the two outer strips facing each other to form strip contacts and having leads connected to the horn circuit. An inner strip or ribbon forms an insulator with openings to allow engagement of the two conductor strips under tactile pressure at any point around the rim. The inner ribbon is coated on both sides with adhesive to hold the strips together in an integral unit. The strips have sufficient memory to separate when pressure is released to open the contacts, and in this regard Mylar or other suitable plastic material is preferred. In an alternative embodiment, two resilient outer strips are also provided. One of the two strips carries a pair of separate strand conductors operable when jump connected to complete the circuit. The other strip has a conductive coating and spans the conductors, and under applied pressure jump connects the conductors through elongated openings in the insulator ribbon.

3 Claims, 2 Drawing Sheets

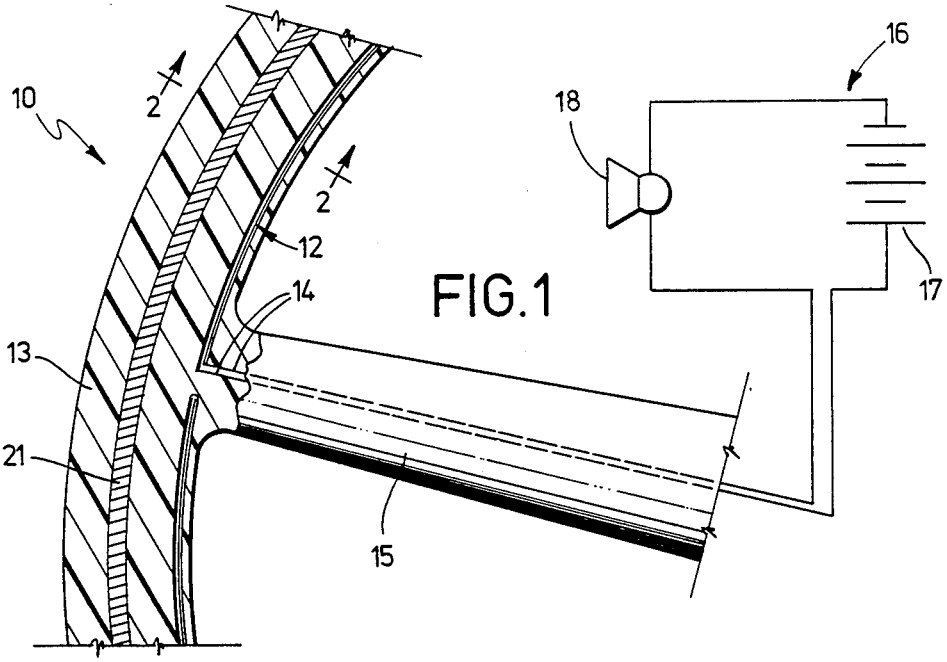
FIG.1
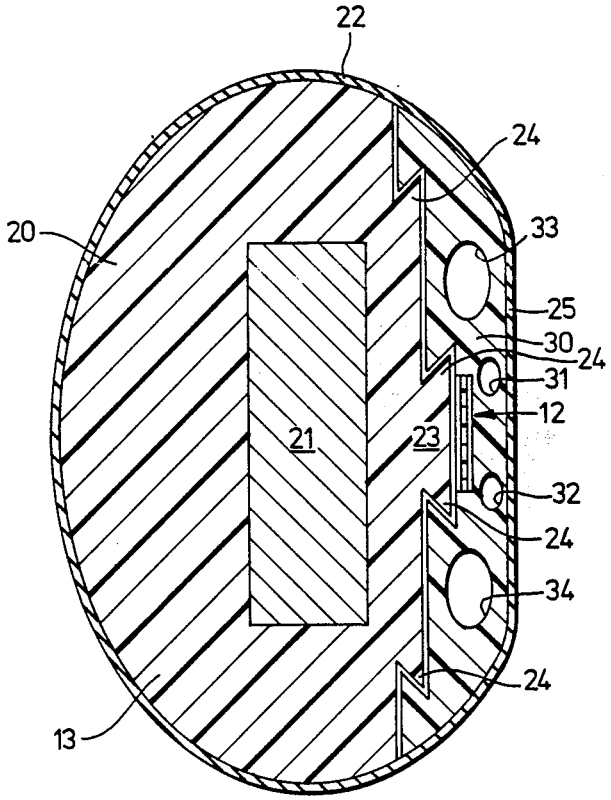
FIG. 2
FIG.3
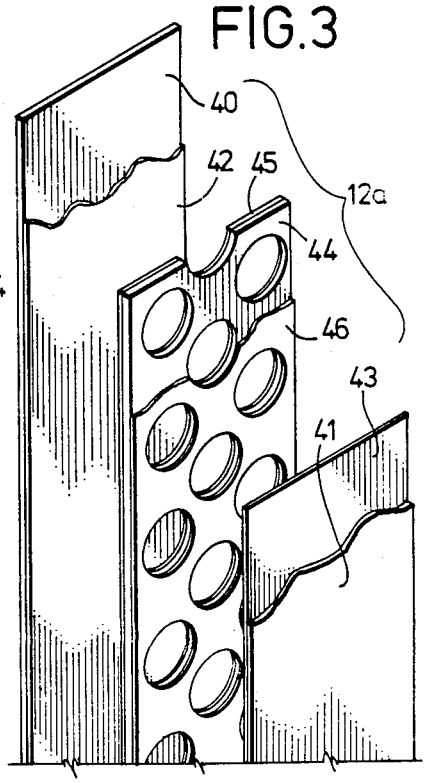

STEERING WHEEL RIM HORN BLOW MECHANISM

BACKGROUND OF THE DISCLOSURE

The present invention relates to pressure actuated electrical switches and, more particularly, to a relatively thin pressure switch for mounting on the rim of a vehicle steering wheel.

BACKGROUND OF THE INVENTION

A key safety device on a vehicle is the horn to be used by the driver to alert others of a potential collison or other impending danger. One of the major factors of making the horn effective is to provide the driver with a conveniently located actuator switch so that the horn can be sounded within a split-second. With the advanced speed of modern automobiles, split-second actuation has become more and more important.

In recent years, automobile engineers have tried several changes in this respect from the simple horn button at the center of the steering wheel. These changes have included such a concept as increasing the size of the horn button to include extensions reaching out along the spokes of the wheel. This allows the driver to actuate the horn circuit by pressure from the thumb as it rests on the spoke adjacent the rim of the wheel. Similarly, the engineers have incorporated a plurality of separate actuator buttons on each of the spokes adjacent to the rim to allow blowing of the horn in the same manner.

These prior art concepts have been generally sucessfully. The driver of the automobile can sound the horn more rapidly since the hand does not have to leave the rim of the wheel. However, these concepts do require the hand be adjacent the spokes of the wheel, which is not always the case. In the instances where an emergency arises with the driver's hands away from the spokes, the time to sound the horn is increased, thus losing the critical split-second advantage.

One broad solution to the shortcoming of having the actuator buttons only on the spokes of the steering wheel is the incorporation of a pressure switch around substantially the full inside periphery of the rim. Thus, the driver can actuate the horn by simply squeezing the inside perimeter by thumb or finger pressure without moving the hand. This can be done regardless of the positioning of the hand on the rim. From an engineering standpoint, this type of pressure switch is successful and has been used in production automobiles. One successful design is shown in the previous to De Vincent U.S. Pat. No. 3,476,897, issued Nov. 4, 1969 and assigned to the assignee of the present invention.

Although successful from an engineering standpoint, the pressure switch of the De Vincent patent has some drawbacks. A key shortcoming of this prior art device is the bulkiness of the design, and the related problem of relatively high cost of manufacture. A related difficulty is that the housing of the switch is exposed to the grip of the driver so that the advantage of a smooth, continuous surface rim portion is sacrificed. At the places where the switch housing joins the molded rim of the steering wheel, there inevitably are gaps in the surface which can be felt by the driver's hand. In addition, these gaps are subject to penetration by moisture and dust to such an extent that the reliability of the switch and the service life is adversely affected.

Also, the prior art design requires a relatively tedious and costly assembly process. The contacts of the switch are formed by metal strips held within slits of the extruded rubber housing. The difficulty of mounting the metal strip contacts results from having to carefully perform a threading operation of the strips through the housing in order to avoid bending or kinking the strips; and under certain conditions, even lubricants between the strips and the slits have to be provided to obtain proper mounting. The extruded housing is difficult and costly to fabricate due to the several projections, cavities and slits that have to be included. Finally, an annular retainer must be used to hold the housing in position further adding to the cost of the parts and assembly, as well as gaps for moisture and dust penetration.

Thus, a need for an improved switch activated by localized finger pressure along the rim of a steering wheel is indicated. With the development of such a switch, the cost and reliability for use in a production vehicle is improved.

OBJECTIVES OF THE INVENTION

Accordingly, one object of the present invention is to overcome the disadvantages of the prior art switches for a vehicle horn circuit, and provide a pressure switch that is relatively thin and compact, and characterized by low cost production and assembly.

It is another object of the present invention to provide a pressure switch particularly adapted for mounting around the inside periphery of the rim of a steering wheel that provides exceptionally high reliability and durability.

Still another object of the present invention is to provide a pressure switch that can be mounted within the rim of a steering wheel for rapid actuation by the driver regardless of the positioning of the hands on the wheel.

A further object of the present invention is to provide a pressure switch for integral mounting in a steering wheel so that there is no annoying irregularities in the wheel and no exposure to the elements.

Still another object of the present invention is to provide an improved pressure actuated switch for use on a steering wheel or the like providing enhanced electrical contact characteristics and improved control touch for the driver for actuation.

SUMMARY OF THE INVENTION

A relatively thin pressure switch is provided that is particularly adapted for integral mounting within the rim portion of a vehicle steering wheel. The switch is mounted within a recess with an elastomeric cover through which tactile pressure is applied to actuate the horn circuit. The outer layer of skin of the rim is continuous providing the maximum in comfort for the driver. In lieu of an outer layer of vinyl, the rim may include a wrap of leather or other desired surface that is preferred by some drivers. Within the elastomeric cover, there may be provided annular voids that are selected to adjust the amount of pressure necessary to actuate the switch.

According to the invention, the switch itself is fabricated of a pair of spaced, resilient strips extending substantially parallel to each other. The strips are selected to have sufficient resiliency to allow pressing together out of parallel by applying localized pressure across the strips. Electrical conductor means on the strips are operable to touch each other when the pressure is applied to complete the circuit and sound the horn. In order to maintain the spacing between the conductors, an insulator ribbon is sandwiched between the strips. The ribbon includes openings to allow the contact when the strips are pressed together.

In accordance with the preferred embodiment, the strips are formed of Mylar plastic, which exhibits the resiliency and flexure memory required to allow relatively easy pressure contact, while at the same time reliable return spring action to separate the conductors when the pressure is released. The conductors are preferably silver ink coatings provided on the strips facing each other and having leads connected to the horn circuit. The inner insulator ribbon is also formed of Mylar plastic strips. The insulator ribbon is coated on both sides with adhesive to hold the strips together in an integral, relatively thin body.

In order to assure reliable actuation of the circuit, the switch is mounted on a central ridge of the main body of the rim of the steering wheel. The elastomeric cover fits in a recess and overlies the switch. To secure the cover, dovetail locking elements are engaged during assembly of the steering wheel. Annular voids in the cover are selected to adjust the amount of pressure needed to activate or close the switch. In the preferred embodiment, a pair of voids are positioned over the switch, one adjacent each lateral edge of the switch. Two larger voids are positioned in the cover, one spaced laterally from each edge of the switch. The voids provide reduced areas of elastomeric material at critical locations permitting easier and controlled depression in the region directly over the switch.

In an alternative embodiment, the pressure switch includes two resilient strips and an insulator ribbon, but with significant changes in the remainder of the structure. Specifically, a pair of strand conductors are mounted on one resilient strip, and elongated, transverse openings are formed in the ribbon so as to allow touching of the strand conductors by the full surface conductor coating of the other strip. Thus, in this embodiment, a jump connection is provided across the strand conductors by the localized pressure engagement.

BRIEF DESCRIPTION OF THE DRAWINGS

FIG. 1 is a schematic showing of a portion of the steering wheel with the pressure switch in position along the inside of the rim and connected to a horn circuit;

FIG. 2 is a cross-sectional view taken along line 2—2 of FIG. 1 illustrating the position of the pressure switch mounted on the support ridge and covered with the elastomeric cover and continuous outer layer or skin;

FIG. 3 is an exploded view of the preferred embodiment of the switch, showing the parts in perspective and with parts broken away for clarity;

DETAILED DESCRIPTION OF THE INVENTION

Figure 4:
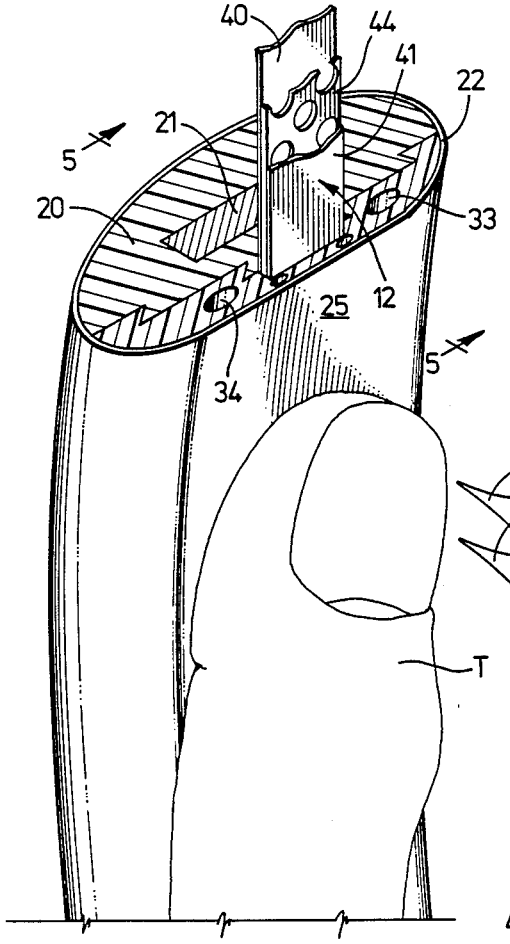
FIG. 4 is an enlarged view of a section of the steering wheel with a cutaway portion illustrating the position of the pressure switch integrally mounted on the rim portion, and in relation to the positioning of the driver's thumb on the rim flat.

With reference to FIG. 1, a steering wheel 10 is provided with a pressure switch 12 formed as a relatively thin strip and embedded along the inside perimeter of the rim 13. The switch 12 has leads 14 extending along spoke 15 of the steering wheel to a horn circuit 16. The circuit includes a battery 17, or other voltage potential source, and a horn 18. As will be seen more completely in detail below, by applying pressure to the switch 12 along the inside of the rim 13, the horn circuit 16 is actuated to sound the horn 18.

To provide more detail of the actual preferred embodiment of the pressure switch 12 of the present invention, and the combination invention with the steering wheel, a closer look at the cross section of the rim 13 is helpful. Thus, in FIG. 2 of the drawings, the rim 13 includes a molded body 20 of semi-resilient plastic or the like supported by an internal metal core 21.

The rim 13 includes a substantially continuous, outer layer or skin 22 of resilient vinyl plastic, wrap of leather or the like. Along the inside edge of the molded body 20, a mounting ridge 23 is provided for positioning of the pressure switch 12. A plurality of dovetail locking elements 24 are formed along this same side of the body 20. As shown, this same side on the inner periphery of the rim 13 has a flat section 25 forming a comfortable resting position for the thumb T of the driver (see FIG. 4 also).

Along this inside periphery and positioned in a recess of the rim 13 over the switch 12 is an elastomeric cover 30, formed of a highly resilient material, such as urethane rubber. The cover 30 is molded to interlock with the dovetail elements 24 of the body 20. A pair of annular voids 31, 32 are positioned adjacent the ends of the switch 12 in order to provide controlled resiliency upon applying finger pressure. Larger annular voids 33, 34 are provided in the enlarged portion of the elastomeric cover 30. The size and spacing of the voids 31–34 are selected to adjust the pressure necessary to provide the most efficient activation of the switch 12. As can be seen in FIG. 2, by positioning the voids 31–34 as shown, the areas of the elastomeric material are reduced providing greater resiliency and the desired controlled flexibility.

The preferred embodiment of the strip switch 12 of the present invention may be viewed in more detail in FIG. 3. The switch 12 preferably includes two outer resilient insulator strips 40, 41 fabricated of Mylar plastic or similar material. The plastic strips 40, 41 extend substantially parallel to each other, as shown, and have sufficient resiliency to be pressed together out of parallel upon applying localized pressure to the flat section 25 (see FIG. 2). A conductive coating 42, 43 is provided on the inside face of each of the strips. The coating is preferably silver ink to provide the desired thinness while maintaining the high conductivity needed for repeated electrical engagement to make and break contact.

An insulator ribbon 44, also preferably formed of Mylar plastic, is sandwiched between the two strips 40, 41. The function of the ribbon is, of course, to space the conductor coatings 42, 43 apart to maintain the horn circuit 16 in the unactuated mode under normal operation. The ribbon 44 includes an adhesive coating 45, 46 on both sides to engage the adjacent silver coatings 42, 43 on the strips 40, 41. Thus, the assembly forms an integral switch unit that may easily be positioned in the rim of the steering wheel, as shown in FIG. 2.

Figure 5:
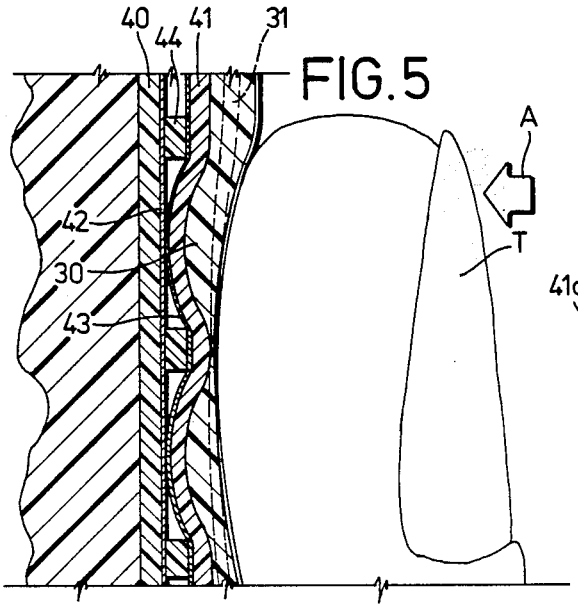
FIG. 5 is an enlarged cross-sectional view taken along line 5—5 of FIG. 4 showing the thumb providing the localized pressure to bring the conductors into contact for activation of the horn circuit.

The ribbon 44 and the adhesive coatings 45, 46 include spaced, substantially circular openings to allow contact between the conductive coatings 42, 43 when the strips 40, 41 are pressed together. This action can best be seen in FIG. 5 where the thumb T is pressed inwardly against the flat section 25 of the rim, as shown by the action arrow A, with sufficient pressure to cause the two facing conductive coatings 42, 43 to make contact. Of course, when the contact is made, the circuit 16 is completed or actuated, causing the horn 18 to sound. As shown, the annular void 31 collapses under the localized pressure providing the desired relief and controlled resiliency.

Figure 6:
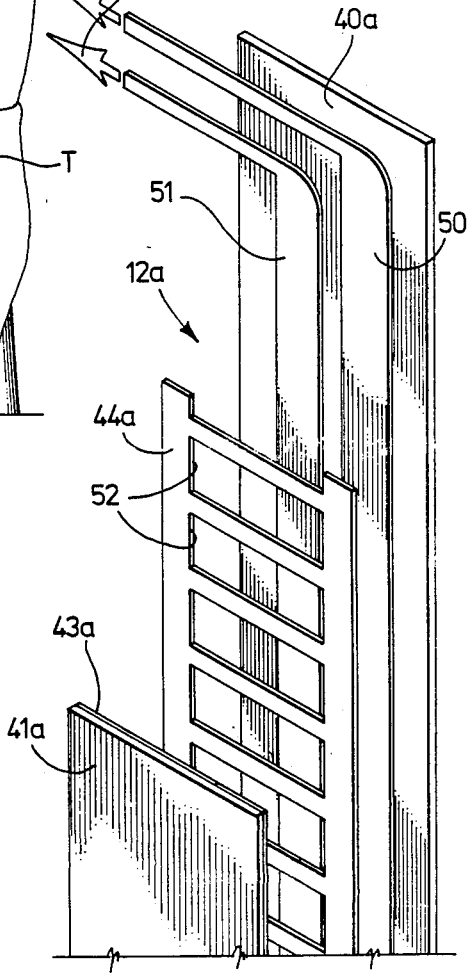
FIG. 6 is an enlarged exploded view with the parts in perspective and portions cut away showing the alternative embodiment of the switch of the invention.

In the alternative embodiment shown in FIG. 6, a pair of elongated strips **40*a*, 41*a* are provided along with an insulator ribbon 44*a*. As in the preferred embodiment, the strips 40*a*, 41*a* are adhesively bonded to the insulator ribbon 44*a* to form a relatively thin strip pressure switch 12*a***.

The signficant differences in the switch **12*a* is that one strip 40*a* carries two strand conductors 50, 51. These conductors 50, 51 are separate and are parallel along their length and adapted to be connected to the leads 14 of the horn circuit 16. Another significant difference is that the insulator ribbon 44*a* includes elongated, transverse openings 52 having sufficient width to span the two strand conductors 50, 51. In addition, the conductive coating 43*a* on the strip 41*a* has sufficient width to span the conductors 50, 51 and is adapted to engage them upon applying localized pressure to the switch 10*a*. As can be thus visualized in FIG. 6, when pressure is applied, a jump connection by the conductor coating 43*a* is provided across the strand conductors 50, 51 and completion of the circuit 16** is provided.

In summary, it can be seen that an improved pressure switch **12, 12*a* is provided that is particularly adapted for mounting along the inside periphery of a steering wheel rim 13. By applying localized pressure to the elastomeric cover 30, the switch 12, 12*a* can be easily actuated from any point along the periphery of the steering wheel. The switch is completely embedded within the rim 13 where it is protected from moisture and dust providing enhanced reliability and durability. Of substantial importance is the advantage of the improved feel of the steering wheel 10 that comes from a substantially continuous outer layer 22**.

The switch **12, 12*a* of the invention is also low cost, and easy to manufacture and assemble into the finished steering wheel 10. In addition to the advantage of lower cost, there is also improved operational characteristics. The strips 40, 41 and 40*a*, 41*a* provide the appropriate resiliency for repeated making and breaking of contact to operate the circuit 16. The silver ink coatings 42, 43, 43*a*** provide improved electrical contact efficiency over prior art devices utilizing metal strips.

Thus, it should be understood that the preferred embodiment and one alternative embodiment were chosen and described to simply provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

We claim:

1. A steering wheel having a rim containing relatively thin pressure switch for actuating a control circuit having an operable electrical device such as a horn, said switch comprising a pair of spaced resilient insulator strips extending substantially parallel to each other mounted on a central ridge of said rim extending along an inside edge thereof, said strips having sufficient resiliency to be pressed together out of parallel upon applying localized pressure across the strips; a conductive coating on the inside face of each said strips and operable to make contact to complete the circuit upon pressing together of said strips;

an insulator ribbon sandwiched directly between said strips to space the strips apart, an adhesive coating on both sides of the insulator ribbon adhering to the adjacent conductive coating on said strips to form said switch into an integral unit and spaced, substantially circular openings along said ribbon to allow contact between the conductive coatings through said ribbon past said adhesive coatings when the strips are pressed toward each other; and elastomeric means overlying said switch along the inside of said rim;

whereby upon applying finger pressure along the inside of the rim, the switch is operated to actuate the control circuit.

2. The steering wheel and pressure switch combination of claim 1, wherein said elastomeric means includes annular voids formed within the body thereof adjacent said switch to provide controlled resiliency upon applying finger pressure to operate the switch.

3. A steering wheel having a rim containing a relatively thin pressure switch for actuating a control circuit having an operable electrical device such as a horn, said switch comprising a pair of spaced resilient insulator strips extending substantially parallel to each other mounted on a ridge of said rim extending along an inside edge thereof, said strips having sufficient resiliency to be pressed together out of parallel upon applying localized pressure across the strips;

a pair of elongated, separate strand conductors positioned on one of said strips and operable when jump connected to complete the circuit;

a conductive coating on the other strip and having sufficient width to span the two strand conductors;

an insulator ribbon with an adhesive coating on both sides sandwiches directly between said strips to space the strips apart while holding said strips together to form said switch into an integral unit and including transverse openings of sufficient width to allow jump connection through said ribbon by the conductor coating across said strand conductors and completion of the circuit when said strips are pressed toward each other; and elastomeric means overlying said switch along the inside of said rim;

whereby upon applying finger pressure along the inside of the rim, the switch is operated to actuate the control circuit.

* * * * *